United States Patent [19]

Musselmann et al.

[11] 4,238,324

[45] Dec. 9, 1980

[54] APPARATUS FOR SEPARATING IMPURITIES FROM FIBER SUSPENSIONS

[75] Inventors: Walter Musselmann; Reimund Rienecker; Herbert Kinzler; Josef Trä, all of Heindenheim, Fed. Rep. of Germany

[73] Assignee: J. M. Voith GmbH, Fed. Rep. of Germany

[21] Appl. No.: 93,635

[22] Filed: Nov. 13, 1979

[30] Foreign Application Priority Data

Nov. 21, 1978 [DE] Fed. Rep. of Germany ..... 2850385

[51] Int. Cl.[3] ..... B07B 1/20

[52] U.S. Cl. ..... 209/255; 209/261; 209/273

[58] Field of Search ..... 209/255, 261, 267, 270, 209/273, 284, 300, 389; 162/328, 357; 210/213, 402, 403

[56] References Cited

U.S. PATENT DOCUMENTS

| | | | |
|---|---|---|---|
| 1,429,707 | 9/1922 | Baker et al. | 209/270 |
| 1,494,027 | 5/1924 | Schettler | 209/270 X |
| 1,921,750 | 8/1933 | Heinrich et al. | 209/273 |
| 2,523,259 | 9/1950 | Aber | 209/300 X |
| 3,034,650 | 5/1962 | Szepan | 209/273 |
| 3,928,188 | 12/1975 | Link et al. | 209/273 X |

*Primary Examiner*—William A. Cuchlinski, Jr.
*Attorney, Agent, or Firm*—Ostrolenk, Faber, Gerb & Soffen

[57] ABSTRACT

The disclosure concerns an apparatus for separating impurities from a fibrous suspension. The apparatus includes a tiltable housing having a screen basket supported coaxially therein. A rotor is supported inside the screen basket. The rotor has three zones. There is an upstream zone communicating with the fiber suspension inlet, and inlet in the upstream zone is into the interior of the rotor and then outward past sorting vanes formed at the exterior of the rotor in the first zone and inside of the basket. Downstream of the transport vanes is a second baffle zone defined by a closed drum having transport vanes on the outside thereof. The suspension and impurities are moved downstream by the transport vanes in the second zone. Downstream of the second zone is a third zone with further means for moving impurities downstream, comprising either a centrifugal impeller in the form of vanes or a helical ring. The impurities outlet from the housing is downstream of the rotor and at the other end of the housing away from the inlet. The outlet for purified suspension is outside the screen basket nearer the inlet. A weir establishes a level of suspension in the housing.

30 Claims, 6 Drawing Figures

APPARATUS FOR SEPARATING IMPURITIES FROM FIBER SUSPENSIONS

The invention relates to apparatus for separating impurities from fiber suspensions, particularly for use in paper-making.

BACKGROUND OF THE INVENTION

Such apparatus is often used in place of a vibration screen which has various disadvantages, such as the development of noise and dirt. German Offenlegungsschrift No. 2,518,112 describes an apparatus including a housing having either a horizontal or a tilted axis and which contains a rotation-symmetrical screen basket. Inside the basket, there is a rotating shaft that is provided with conveyor elements that are arranged coaxially to the basket axis. A supply line for the fiber suspension which is to be cleaned leads into the interior of the screen basket at one end of the basket. An outlet opening for deposited impurities is arranged at the other end of the basket. A discharge pipe for the cleaned suspension is arranged between the screen basket and the housing wall. In the apparatus in the German publication, the impurities are deposited by a type of worm or screw thickener having a tilted axis. The suspension which is to be cleaned is fed into the interior of the screen basket at the lower end. Liquid and fibers pass through the screen basket and the impurities which are to be deposited are transported upward by the worm shaft and are removed via the impurities outlet opening.

A disadvantage of the above-described device is that either transport difficulties occur in respect of the impurities which are to be deposited, or insufficient water extraction occurs. If the liquid level in the housing is set to be low, although good dewatering takes place, the transportation of the impurities to the impurities outlet opening presents difficulties since the numerous small particles are difficult to transport with the conveyor worm. If, on the other hand, the liquid level is set to be sufficiently high to improve the transportation of impurities, the impurities are inadequately thickened before they are removed from the housing via the impurities outlet opening.

SUMMARY OF THE INVENTION

It is the object of the invention to effectively separate impurities from a fiber suspension, and particularly to separate, transport and properly thicken the impurities. Desirable water removal from the impurities is another object.

The present invention provides an apparatus for separating impurities from fiber suspensions and comprises a housing having a horizontal axis or a tilted axis. The housing contains a rotation-symmetrical screen basket. There is an inlet at one end of the apparatus for suspension to be cleaned and it leads into the interior of the screen basket. There is an impurities outlet for separated impurities at the other end of the apparatus. There is a suspension outlet for the discharge of cleaned suspension from the region between the screen basket and the wall of the housing.

The suspension outlet is provided with weir means which maintain a minimum suspension level in the housing. The level of the liquid in the housing can be adjusted via the weir means.

A rotor is disposed coaxially within the screen basket. Preferably, the rotor is mounted in cantilever fashion only at one end thereof, namely, the end at which the inlet to the apparatus is situated, so that the outlet end of the rotor remains free of disturbing components which facilitates better control.

The interior of the screen basket contains a first, upstream zone. In this zone, the rotor is open in that the inlet to the apparatus communicates into the rotor, and the rotor is essentially open so that suspension flows out of it. The rotor in the first zone is provided with generally axially extending sorting vanes that are positioned at a radial distance from the axis of the open rotor and these vanes are arranged so that a screen gap is formed between the sorting vanes and the screen basket.

The upstream zone is followed by a second zone provided with baffle means. The residence time of the suspension in the first zone is increased by the baffle means, which helps separation and thickening of the impurities.

In one preferred arrangement of the invention, the baffle means comprise a closed drum whose surface is provided with transport vanes and the vanes form a screen gap with the screen basket around them. The closed drum follows the first zone in which the rotor is open. Thus, the upstream end of the closed drum forms a baffle wall and the suspension and impurities move outwardly around this wall and downstream over the drum. The vanes on the surface of the drum form the continuation of the screen gap from the first open rotor zone and the vanes serve for transportation purposes. To improve the cleaning of the fiber suspension, it is advantageous for the downstream part of the drum to have a smooth surface zone which is free of components, and this forms a barrage or barrier zone. This barrage zone ensures that the suspension remains for a sufficient length of time in the second zone. At this point, a barrage or barrier wall is formed in practice from deposited impurities. Further transportation away from this smooth surface zone of the drum takes place automatically as a result of the impurities displaced by the transport vanes forcing the impurities downstream of the vanes to move.

If it is desired to free the deposited impurities of fibers still adhering them, a water supply pipe leads into the interior of the drum and the drum surface is provided with bores which serve as spray nozzles. The impurities are thereby washed away.

In a preferred arrangement, in a third zone of the screen basket, the rotor is provided with means that move the impurities toward the impurities outlet, e.g. further vanes which form a centrifugal impeller.

Good separation, transportation and thickening of the impurities which are to be deposited can be achieved by the division of the interior of the screen basket into three zones. In the region of the upstream, first or sorting vane zone, sorting, i.e. separation of the impurities from the fibers and the water, takes place in the screen gap. In the lower region or bottom side of the basket, this zone is generally fully submerged in the suspension. The following second zone containing the baffle means ensures that the suspension which is to be cleaned remains for a sufficient period of time in the first sorting zone.

In the third zone, on account of the centrifugal action of the rotating vanes, water removal takes place in the third zone. The centrifugal vanes also serve to transport the thickened impurities towards the outlet opening. For transportation of the thickened impurities toward the outlet opening, the rotor may be provided with a helical ring.

Preferably, a barrage or barrier edge precedes the outlet opening for the deposited impurities. In this way the impurities which are to be deposited are obstructed to a somewhat greater extent, which improves water removal.

The outlet opening for separated impurities may be arranged in the housing cover. This provides a simple structural solution. Also, the housing cover can be provided with an inspection opening. In this way, it is possible to observe the functioning and deposition operation of the device in a simple manner so that any changes regarding the speed of the shaft, the stock level, and the like can be carried out rapidly and efficiently.

If desired, the level of the suspension relative to the filter basket can be adjusted by means of a pivot device by which the housing can be pivoted in the vertical direction away from having a horizontal axis. This allows flexibility of operation. Depending upon the requirements, e.g. the desired dryness of the impurities which are to be deposited or the nature of the impurities, the correct barrage or barrier level or suspension level can always be set.

It is advantageous for the level of the suspension in the housing to be adjustable by means of a controllable overflow protection means, like the weir means. This allows the barrage level to be regulated in a simple manner.

BRIEF DESCRIPTION OF THE DRAWINGS

Other objects and features of the invention will be apparent from the following description taken with reference to the accompanying drawings.

DESCRIPTION OF THE PREFERRED EMBODIMENTS

Figure 1:
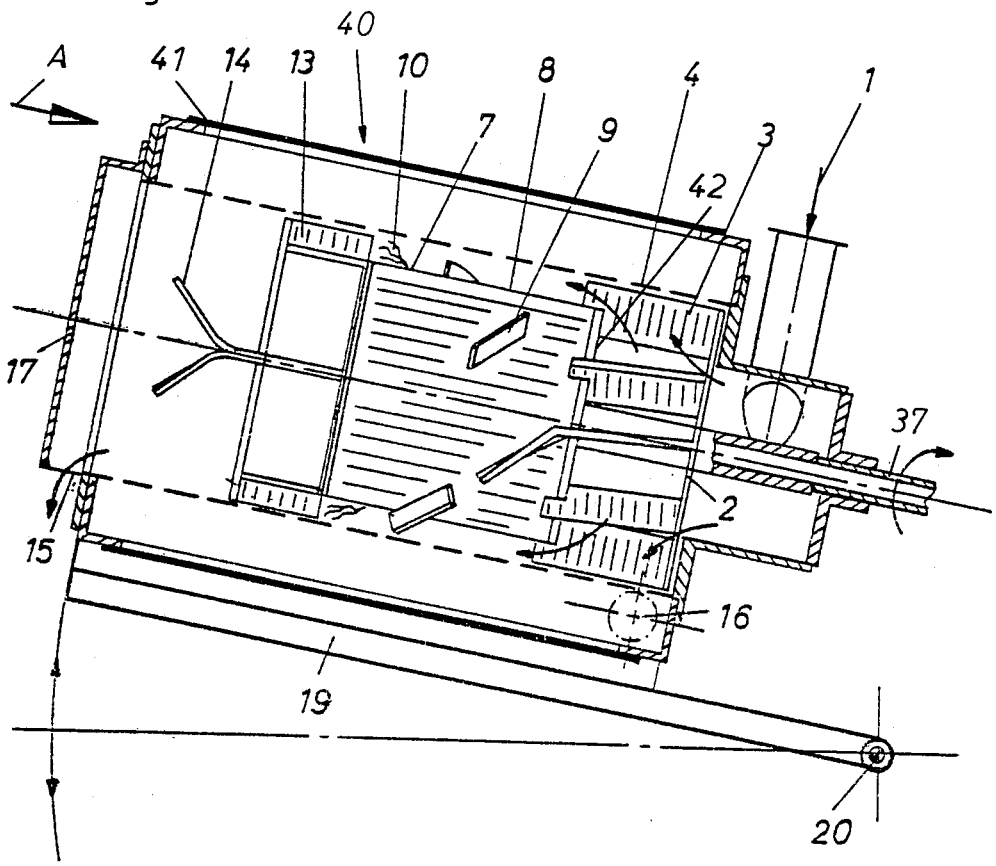
FIG. 1 is a longitudinal sectional view through one embodiment of the apparatus according to the invention.
Figure 2:
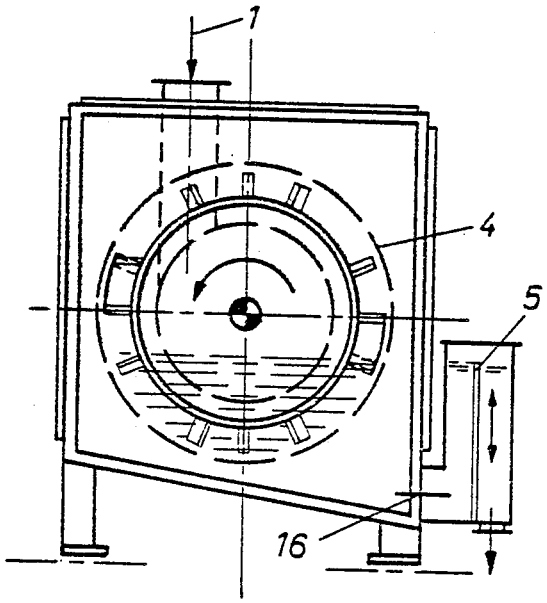
FIG. 2 is an end view taken in the direction of the arrow A of FIG. 1.

The separating apparatus shown in FIGS. 1 and 2, is operated without excess pressure. The entire apparatus is tilted from the horizontal. Fiber suspension enters via an inlet pipe 1 into one end of the housing 40 of the apparatus, preferably the lower end.

A rotor 2 is rotatably mounted on and is coaxial with a drive shaft 37. The rotor is surrounded by an annular, screen-like, porous basket 4. The basket is fixed in the external housing 40 of the apparatus. The mesh of the basket is small enough to block passage of impurities but large enough that desirable fibers separated from the impurities will pass outward through the basket.

The rotor 2 comprises three zones. In a first zone, the rotor is open and the inlet pipe 1 communicates into the open center of the rotor. In the first zone, the rotor includes, slightly inclined, sorting vanes 3 for feeding the suspension to the screen basket 4. The vanes 3 are slightly off being parallel to the axis of the rotor 2 and project radially outwardly of the rotor. The open annular chamber defined within the first zone of the rotor 2 radially inside the vanes 3 and the fact that the sorting vanes 3 are tilted only slightly from the axial direction of the rotor result in a longer period of dwell which ensures good sorting.

A cleaned suspension discharge pipe 16 leads out of the annular chamber that is defined between the screen basket 4 and the annular housing wall 41 of the apparatus. The pipe 16 is near the same end of the housing 40 as the inlet pipe 1. The pipe 16 leads into an overflow weir 5 (FIG. 2) which can be adjusted in height and which serves to set the stock or suspension level in the housing. The material which remains on the screen or basket is remixed with water in the fiber sump until the cleaned fibers then float through the screen 4 and are discharged through the discharge pipe 16 via the weir 5. This alternation of water removal and dilution caused by rotation of the rotor results in good separation of dirt and fibers.

Figure 3:
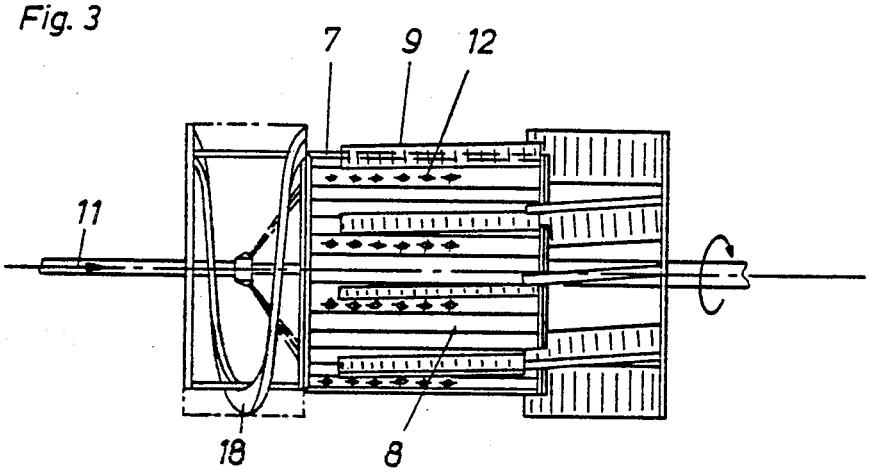
FIGS. 3 to 5 illustrate various alternate embodiments of the rotor for the device with respective conveyor elements.
Figure 4:
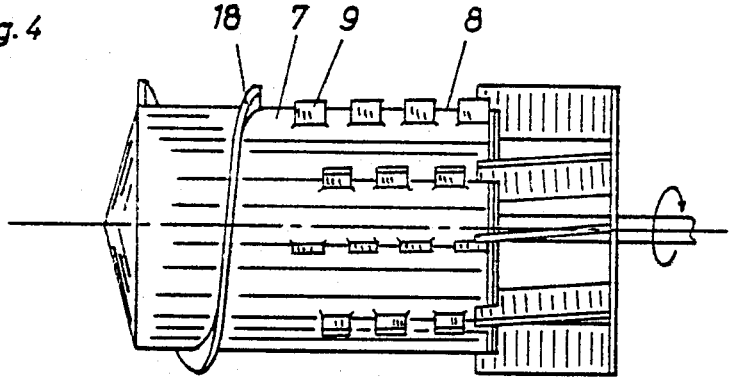
Figure 5:
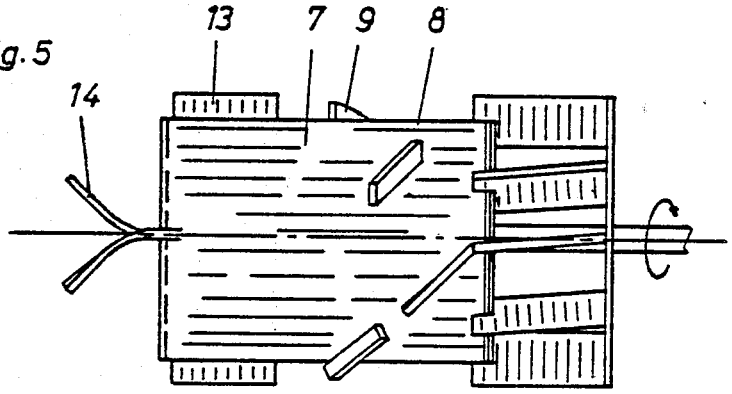

The central part of the rotor 2 in a second zone comprises a substantially closed cylindrical drum 8. The upstream wall 42 of the drum 8 serves as a baffle which redirects the flow of suspension and impurities outwardly from inside the rotor and between the sorting vanes 3. The drum 8 has outwardly projecting transport vanes 9 on its surface, which serve to move the contaminants along. As illustrated in FIGS. 3 to 5, the design of the vanes 9 can be selected to suit the particular application.

In order to avoid too rapid transportation of dirt or impurities, with an attendant excessive loss of fibers, the end portion of the drum 8 remote from the inlet 1 is free of components like vanes 9 on its surface. The vanes 9 thus stop short of the end of the drum. On this free downstream surface zone 7 of the drum, during use of the apparatus, a constantly rotating dirt ring 10 is formed, which acts as a barrage or barrier zone which fills the radially extending space between the screen basket 4 and the rotor 8. The dirt ring is moved onward by following dirt. The fiber sump is generally also adjusted by the weir 5 up to this dirt ring 10.

In the case of stock or suspension containing long fibers, the washing process in the region of the drum 8 can be assisted by a supply of water, as illustrated in FIG. 3. Water is supplied to the interior of the drum 8 by a water supply pipe 11. The surface of the drum 8 is provided with outlet bores 12 so that water leaves the drum and enters the screen zone outside the drum as a result of centrifugal force.

Referring to FIGS. 1 and 2, the third part of the rotor in a third zone comprises axially extending centrifugal vanes 13. Here further water is removed from the impurities that are picked up by the centrifugal vanes. The impurities are then ejected with a dryness of 15% to 25% through an outlet opening 15 arranged in a housing cover 17.

In order to improve the ejection of the impurities through the outlet opening 15, ejector vanes 14 are provided on the downstream end of the rotor. Instead of ejector vanes 14, as shown in FIGS. 3 and 4, a spiral shaped ring 18 may be provided, which either is arranged on an extension at the output end of the drum 8 (FIG. 4) or rotates freely from the drum in the interior of the screen basket 4 (FIG. 3).

The rotor 2 is mounted in overhung fashion in the housing 40 only at the inlet end so that the outlet end of the housing at 15, 17 is free of fittings which might disturb the operation of the apparatus.

The entire assembly is secured to a frame 19 which can be pivoted in the vertical direction about a horizontal pivot axis 20. Any desired tilt can be selected to adjust for the nature of the stock, the density of the fibers and the perforations of the screen.

Figure 6:
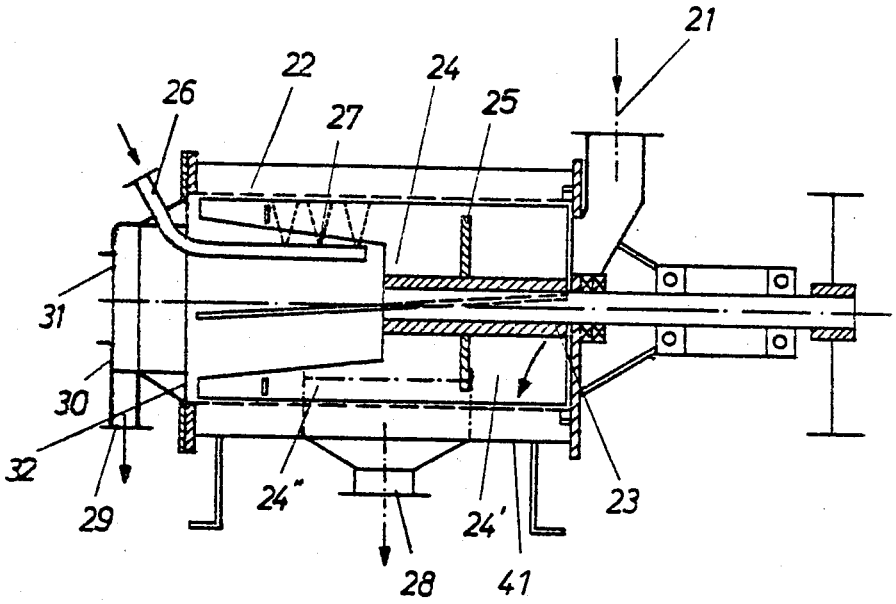
FIG. 6 is a longitudinal sectional view through a further embodiment of the apparatus according to the invention.

FIG. 6 illustrates another embodiment of the invention. Here the stock or suspension which is to be cleaned is supplied via a supply pipe 21 into the interior of a screen basket 22. A rotor shaft 23, which is provided with axially elongated, annularly spaced apart vanes 24, rotates inside the screen basket 22. The shaft 23 with the vanes 24 is again divided into three zones in the flow direction. The shaft 23 carries a plurality of annularly distributed vanes 24 which extend the entire length of the screen basket. Each vane 24 may comprise either one appropriately shaped component or a plurality of subvanes arranged end-to-end.

In the first zone, the vanes serve as sorting vanes 24'. A baffle plate 25 around the shaft 23 increases the period of dwell of the suspension in the first zone. The plate 25 acts like the drum wall 42. In the central zone (second zone), the vanes 24 serve as transport and centrifugal vanes 24''. The fibers still adhering to the impurities are removed with the aid of water supplied by a water supply pipe 26 which feeds spray nozzles 27 that are located at the beginning of the third zone and that are directed to spray outwardly toward the screen basket 22. The remainder of the third zone serves for water removal and for drying of the impurities which are to be ejected.

The discharge pipe 28 for the purified suspension branches out of an annular chamber between the screen basket 22 and the housing wall 47 and communicates with a weir device, as described with reference to FIG. 2. An outlet opening 29 for the deposited impurities is contained in the downstream housing cover 30. The housing cover is provided with a barrage or barrier edge 32, which obstructs the impurities somewhat at the end of the screen basket 22. This increase in the period of dwell of the impurities results in particularly good water removal. The interior of the screen basket can be observed through an opening 31 in the cover 30. Again, the apparatus can be provided with a tilting device.

The devices described are found to provide satisfactory separation of impurities from fiber suspensions with good water extraction, without involving excessive transportation difficulties.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. Apparatus for separating impurities from fibrous suspensions, comprising:

a housing having a housing wall; an annular basket in said housing; said basket being spaced in from said housing internal wall;

an inlet for suspension to be cleaned and leading into said basket; a first outlet from said housing, spaced from said inlet, for separated impurities;

a second outlet communicating with the space between said basket and said housing wall for discharge of cleaned suspension;

weir means connected with said housing for maintaining a minimum level of fibrous suspension in said housing;

a rotatable rotor disposed within said screen basket and rotatable around its axis in said screen basket;

said screen basket having an interior containing a first upstream zone; in said first zone, said rotor having generally axially extending sorting vanes, located at a radially spaced distance from the axis of said rotor, and each said sorting vane also being spaced inwardly from said screen basket so that a screen gap is formed between said sorting vanes and said screen basket;

said screen basket having a second zone therein, downstream of said first zone with respect to the movement of impurities; said rotor having baffle means thereon at said second zone for inhibiting downstream flow of impurities.

2. The apparatus of claim 1, wherein said housing has an axis which is tiltable from an orientation at which the axis is horizontal to an orientation at which the axis is not horizontal.

3. The apparatus of claim 2, further comprising means for tilting said housing.

4. The apparatus of claim 1, wherein said screen basket has a third zone therein, downstream of said second zone with respect to the movement of impurities; said rotor having suspension moving means thereon at said third zone, for moving impurities at and past said third zone.

5. The apparatus of claim 4, wherein said suspension moving means comprise vanes on said rotor, which form a centrifugal impeller.

6. The apparatus of either of claims 1 or 4, wherein said first outlet is located downstream of said rotor and downstream of said screen basket zones.

7. The apparatus of claim 4, wherein said screen basket has a third zone therein downstream with respect to movement of impurities through said housing of said second zone; said rotor having a helical ring thereon which forces downstream transport of fibrous suspension and impurities at said third zone.

8. The apparatus of claim 6, further comprising a barrage edge located in front of said first outlet for inhibiting exit of separated impurities through said first outlet.

9. The apparatus of claim 6, wherein said housing has a removable cover in which said first outlet is provided.

10. The apparatus of claim 9, further comprising a barrage edge that is formed by said housing cover and that is located in front of said first outlet for inhibiting exit of separated impurities through said first outlet.

11. The apparatus of either of claims 1 or 4, wherein at said first zone of said screen basket, said rotor is open and said open rotor at said first zone communicates with said inlet, such that inlet to said basket is to the inside of said rotor at said first zone and inletting fluid suspension then moves out from inside of said rotor to pass by said sorting vanes.

12. The apparatus of claim 11, wherein said baffle means comprise a closed drum in said screen basket and said drum having an upstream end which baffles the downstream movement of impurities; said drum having an outer peripheral surface downstream of said upstream end and carrying transport vanes thereon which are oriented and shaped to impel impurities downstream through said zones; said transport vanes defining a screen gap between themselves and said screen basket.

13. The apparatus of claim 12, wherein said drum has a downstream end portion thereof, located downstream with respect to the movement of impurities through said housing; and at said drum downstream end portion, said drum has an outer surface which is unobstructed and smooth for forming a barrage zone for impurities.

14. The apparatus of claim 11, wherein said inlet is at one end of said housing, upstream of said first zone.

15. The apparatus of claim 14, wherein said first outlet is located downstream of said rotor and of said screen basket zones and at the end of said housing away from said one end of said housing.

16. The apparatus of claim 14, wherein said rotor is supported in said housing only at said one end of said housing.

17. The apparatus of claim 16, wherein said baffle means comprise a closed drum in said screen basket and said drum having an upstream end which baffles the downstream movement of impurities; said drum having an outer peripheral surface downstream of said upstream end and carrying transport vanes thereon which are oriented and shaped to impel impurities downstream through said zones; said transport vanes defining a screen gap between themselves and said screen basket.

18. The apparatus of either of claims 1 or 4, wherein said inlet is at one end of said housing, upstream of said first zone; and said first outlet is located downstream of said rotor and of said screen basket zones and at the end of said housing away from said one end of said housing.

19. The apparatus of claim 18, further comprising a barrage edge located in front of said first outlet for inhibiting exit of separated impurities through said first outlet.

20. The apparatus of claim 18, wherein said rotor is supported in said housing only at said one end of said housing.

21. The apparatus of either of claims 1 or 4, wherein said baffle means comprise a closed drum in said screen basket and said drum having an upstream end which baffles the downstream movement of impurities; said drum having an outer peripheral surface downstream of said upstream end and carrying transport vanes thereon which are oriented and shaped to impel impurities downstream through said zones; said transport vanes defining a screen gap between themselves and said screen basket.

22. The apparatus of claim 21, further comprising a water supply into said drum, and said drum having spray nozzle means therein for spraying the water from said water supply outwardly of said drum toward said screen basket.

23. The apparatus of claim 21, wherein said drum has a downstream end portion thereof, located downstream with respect to the movement of impurities through said housing; and at said drum downstream end portion, said drum having an outer surface which is unobstructed and smooth for forming a barrage zone for impurities.

24. The apparatus of claim 21, wherein said screen basket has a third zone therein downstream with respect to movement of impurities through said housing of said second zone; said rotor having a helical ring thereon which forces downstream transport of impurities at said third zone.

25. The apparatus of either of claims 1 or 4, wherein said rotor is coaxial with said screen basket.

26. The apparatus of claim 1, wherein said weir means are connected with said second outlet.

27. The apparatus of claim 26, wherein said weir means are adjustable for adjusting the stock level of suspension in said housing.

28. The apparatus of claim 1, wherein said housing has a removable cover in which said first outlet is provided.

29. The apparatus of claim 28, wherein said housing cover includes an inspection opening.

30. The apparatus of claim 29, further comprising a barrage edge that is formed by said housing cover and that is located in front of said first outlet for inhibiting exit of separated impurities through said first utlet.

* * * * *